US009737976B2

(12) United States Patent
Christensen

(10) Patent No.: US 9,737,976 B2
(45) Date of Patent: Aug. 22, 2017

(54) CLAMPING DEVICE

(71) Applicants: 9. Solutions Technology Co., Limited, Hong Kong (CN); Bo Christensen, Nordborg (DK)

(72) Inventor: Bo Christensen, Nordborg (DK)

(73) Assignee: SOLUTIONS TECHNOLOGY CO., LIMITED, Hong Kong (HK)

( * ) Notice: Subject to any disclaimer, the term of this patent is extended or adjusted under 35 U.S.C. 154(b) by 0 days.

(21) Appl. No.: 14/848,291

(22) Filed: Sep. 8, 2015

(65) Prior Publication Data

US 2016/0067846 A1 Mar. 10, 2016

(30) Foreign Application Priority Data

Sep. 10, 2014 (CN) ..... 2014 2 0517548 U

(51) Int. Cl.
*B25B 5/04* (2006.01)
*B25B 5/16* (2006.01)
*B25B 5/10* (2006.01)

(52) U.S. Cl.
CPC ..... *B25B 5/163* (2013.01); *B25B 5/04* (2013.01); *B25B 5/103* (2013.01)

(58) Field of Classification Search
CPC ..... B25B 1/24; B25B 1/2405; B25B 1/241; B25B 5/04; B25B 5/103; B25B 5/147; B25B 5/16; B25B 5/163
See application file for complete search history.

(56) References Cited

U.S. PATENT DOCUMENTS 1,423,933 A * 7/1922 Heatlie ..... B25B 5/10 15/220.3
2,284,449 A * 5/1942 Rodess ..... B25B 1/2452 269/261
3,736,629 A * 6/1973 Blake ..... B25B 5/103 24/514
4,278,246 A * 7/1981 Blake ..... B25B 5/103 269/220

(Continued)

FOREIGN PATENT DOCUMENTS

DE WO 9304822 A1 * 3/1993 ..... B25B 5/127
EP 0104286 A1 * 4/1984 ..... B23B 31/16275

*Primary Examiner* — Joseph J Hail
*Assistant Examiner* — Tyrone V Hall, Jr.
(74) *Attorney, Agent, or Firm* — Bruce Stone LLP; Joseph Bruce

(57) ABSTRACT

A clamping device includes: a clamp assembly and an adjustment assembly, the clamp assembly comprises two symmetrical clamp arms which are oppositely hinged to each other. Each of the clamp arms includes two identical and parallel clamp pieces, and a jaw, the jaw is detachably connected between the two clamp pieces, a lower edge of the jaw includes, in order from left to right, a first arc-shaped section, a second arc-shaped section and a horizontal section, the bottoms of the first arc-shaped section, the second arc-shaped section and the horizontal section are at a same plane, the first and second arc-shaped sections are symmetrical to each other, an angle is defined between the first and second arc-shaped sections, a V-shaped groove is defined between the second arc-shaped section and the horizontal section, and the first and second arc-shaped sections are each longer than the horizontal section.

11 Claims, 2 Drawing Sheets

(56) References Cited

U.S. PATENT DOCUMENTS 4,619,447 A * 10/1986 Blake ..... B25B 5/103
24/514
4,669,170 A * 6/1987 Blake ..... B25B 5/103
29/257
5,809,623 A * 9/1998 Dykstra ..... B25B 5/04
24/483

* cited by examiner

CLAMPING DEVICE

CROSS REFERENCE TO RELATED APPLICATION

This application claims the benefit of priority to CN 201420517548.9, filed on Sep. 10, 2014 with the State Intellectual Property Office of the People's Republic of China, the entire specification of which is incorporated herein by reference.

BACKGROUND OF THE INVENTION

Field of the Invention

The present invention relates to a clamping device.

Related Prior Art

Clamping devices are commonly seen in our daily life and bring much convenience to us, and are favored since they can clamp workpiece conveniently. There are various clamping devices currently available in the market, however, most of the clamping devices only have one or two clamping points to clamp the workpieces, so that the workpieces cannot be held tight and are likely to get loose. Increasing the clamping force would cause damage to the workpiece. Some clamping devices are specially designed in size and shape to fit the size and shape of a specific type of workpiece, and therefore are unable to clamp workpieces of different shapes or sizes. For example, pipe-like workpieces must be clamped by arc-shaped clamping device, and angular workpieces can only be clamped by angular clamping device, which not only causes inconvenience but also increases cost.

The present invention has arisen to mitigate and/or obviate the afore-described disadvantages.

SUMMARY

The present invention is aimed at providing a clamping device which has at least four clamping points to clamp the workpieces, and is capable of clamping differently sized and shaped workpieces with less damage.

Therefore, a clamping device provided by the present invention comprises: a clamp assembly and an adjustment assembly, the clamp assembly comprises two symmetrical clamp arms which are oppositely hinged to each other. Each of the clamp arms includes two identical and parallel clamp pieces, and a jaw, the jaw is detachably connected between the two clamp pieces, a lower edge of the jaw includes, in order from left to right, a first arc-shaped section, a second arc-shaped section and a horizontal section, the bottoms of the first arc-shaped section, the second arc-shaped section and the horizontal section are at a same plane, the first and second arc-shaped sections are symmetrical to each other, an angle is defined between the first and second arc-shaped sections, a V-shaped groove is defined between the second arc-shaped section and the horizontal section, and the first and second arc-shaped sections are each longer than the horizontal section.

Preferably, the second arc-shaped section and the horizontal section are each provided with toothed surface.

Preferably, a ⅜ inch threaded hole and a ¼ inch threaded hole are formed at a top end surface of the jaw.

Preferably, an elongated pin hole which is arranged in an inclined manner is formed at a left end of the jaw, two ends of the elongated pin hole are in the shape of a semicircle, and a pin hole is formed at a right end of the jaw, the two clamp pieces are provided with clamp-piece pin holes, the left and right ends of the jaw are connected to the clamp pieces by round pins, the round pin at the right end of the jaw is inserted in the elongated pin hole, so that the jaw is rotatable, and rotation of the jaw is restricted by relative displacement between the round pin and the elongated pin hole.

Preferably, each of the clamp arms further includes a fixing rod fixed between the two clamp pieces, the adjustment assembly includes a bolt, a nut and a spring, the bolt inserts upwards through the fixing rods on the two clamp arms and then has a top end screwed with the nut, and the spring is sleeved onto the bolt and located between the fixing rods on the two clamp arms.

Preferably, a stop block is provided at a lower end of the bolt.

The advantages of the present invention are described as follow: the jaw is detachably connected between the two clamp pieces, the jaw is replaceable, which reduces the cost.

A lower edge of the jaw includes, in order from left to right, a first arc-shaped section, a second arc-shaped section and a horizontal section, so as to clamp different workpieces of different shapes. The bottoms of the first arc-shaped section, the second arc-shaped section and the horizontal section are at the same plane, so that the clamping device will have at least four clamping points when clamping a workpiece, which allows the workpiece to be clamped more stably and easily. The arc-shaped configuration of the first and second arc-shaped sections and can reduce damage to the workpiece to be clamped. The first and second arc-shaped sections are symmetrical to each other, between the first and second arc-shaped sections is defined an angle, and between the second arc-shaped section and the horizontal section is defined a V-shaped groove. The first and second arc-shaped sections are each longer than the horizontal section. The angle and the V-shaped groove are used to clamp angular workpiece or small sized workpiece. Relatively large workpiece can be clamped between the first and second arc-shaped sections, and small workpieces can be clamped between the second arc-shaped section and the horizontal section. The second arc-shaped section and the horizontal section are provided with a toothed surface, which is an anti-skid design to increase friction of the jaw with respect to the workpiece. At the top end surface of the jaw are formed a ⅜ inch threaded hole and a ¼ inch threaded hole, so that some other workpieces or tools can be fixed to the jaw. Hence, the present invention requires less installation space, and is easy to set up or take down. An elongated pin hole which is arranged in an inclined manner is formed at a left end of the jaw, two ends of the elongated pin hole are in the shape of a semicircle, and a pin hole is formed at a right end of the jaw, the two clamp pieces are provided with clamp-piece pin holes, the left and right ends of the jaw are connected to the clamp pieces by round pins, the round pin at the right end of the jaw is inserted in the elongated pin hole, so that the jaw is rotatable, and rotation of the jaw is restricted by relative displacement between the round pin and the elongated pin hole. The jaw can be flexibly adjusted to clamp bigger workpiece. The clamping device of the present invention is reliable, easy to use, and capable of clamping different sized or shaped workpieces with less damage.

DETAILED DESCRIPTION

The present invention will be clearer from the following description when viewed together with the accompanying drawings, which show, for purpose of illustrations only, the preferred embodiment in accordance with the present invention.

Figure 1:
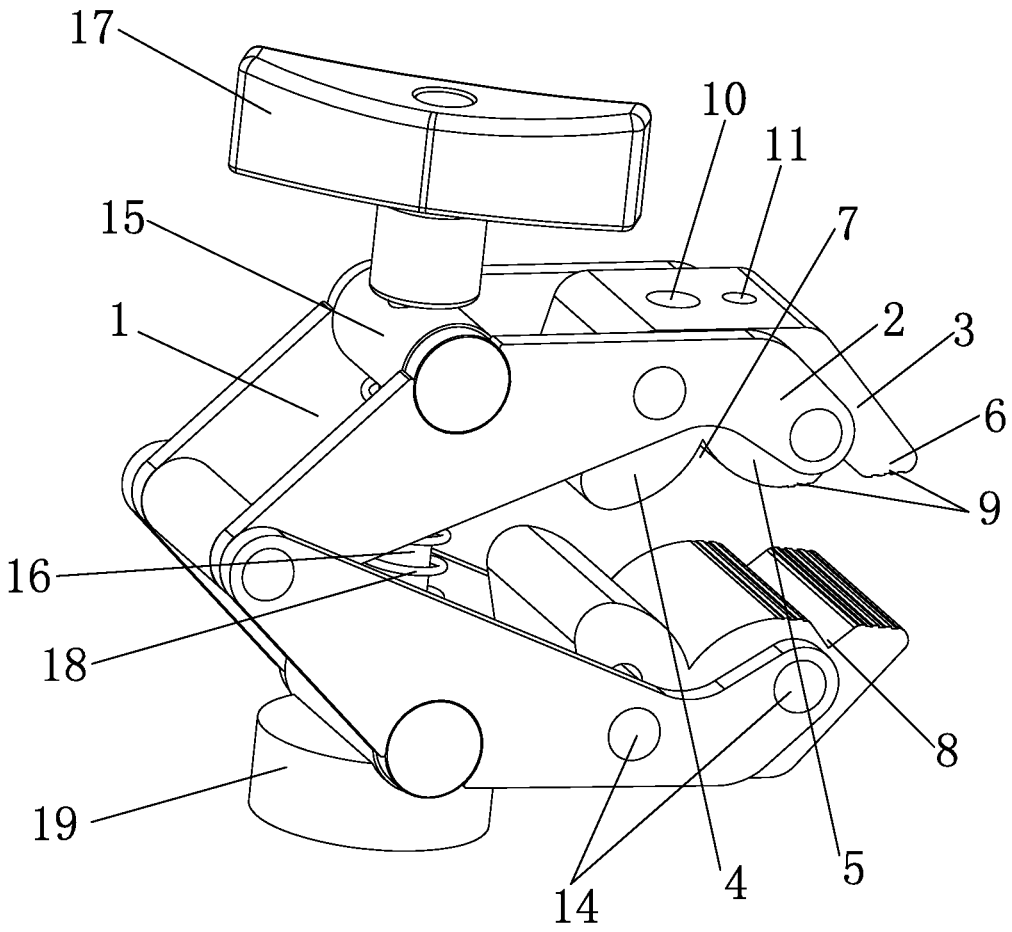
FIG. 1 is an illustrative view of a clamping device of a preferred embodiment of the present invention.

Referring to FIG. 1, a clamping device in accordance with a preferred embodiment of the present invention comprises a clamp assembly and an adjustment assembly. The clamp assembly comprises two symmetrical clamp arms 1 which are oppositely hinged to each other. The adjustment assembly is capable of adjusting the distance between the two clamp arms 1 to allow the clamping device to clamp workpieces of different sizes. The clamping device in accordance with the present embodiment is able to clamp workpieces of different shapes, such as round shape, arc shape, square shape, and angular shape.

Figure 2:
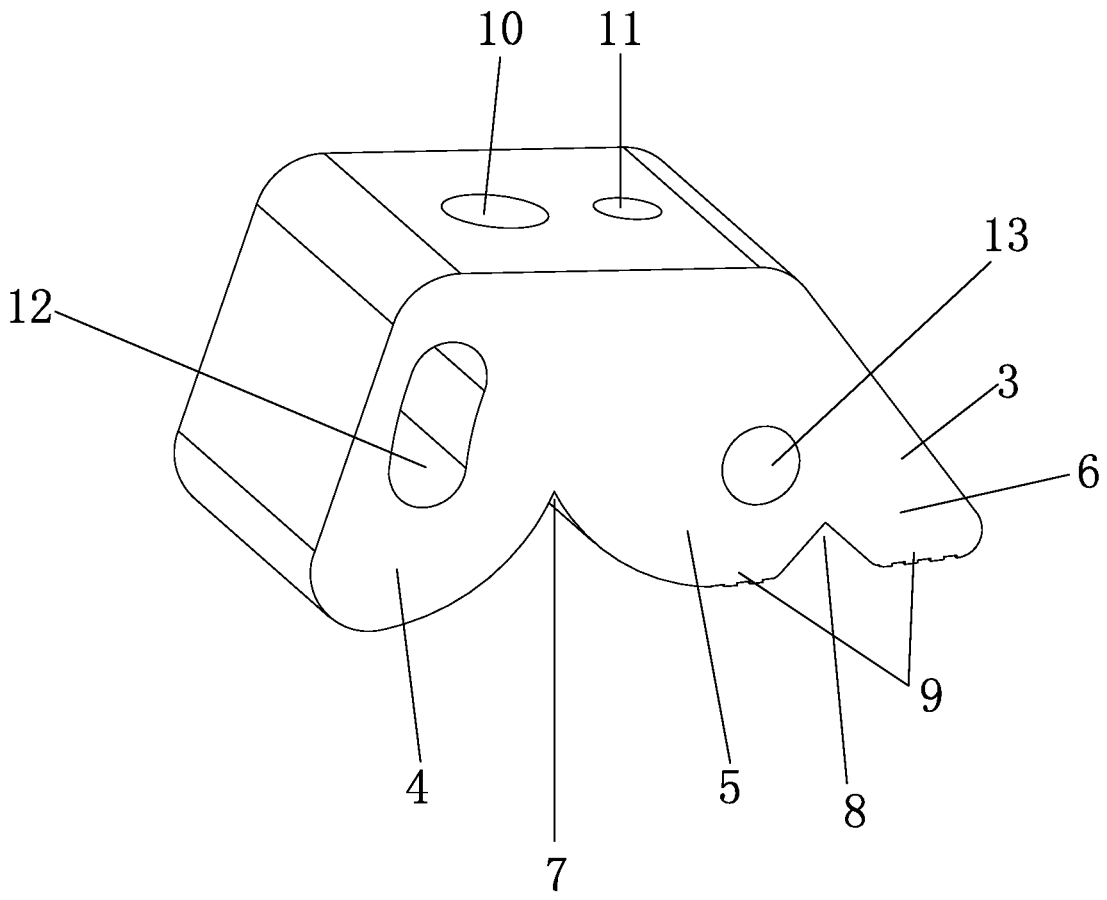
FIG. 2 shows a jaw of the clamping device of the preferred embodiment of the present invention.

Since the clamp arms 1 are identical structures and for easy explanation, only one clamp arm 1 will be described in detail. The clamp arm 1 includes two clamp pieces 2, a jaw 3 and a fixing rod 15. The clamp pieces 2 are identical and arranged in a parallel manner. The fixing rod 15 is fixed between the two clam pieces 2. The jaw 3 is trapezoidal in cross section and detachably connected between the two clamp pieces 2. More specifically, as shown in FIG. 2, at the left end of the jaw 3 is formed an elongated pin hole 12 which is arranged in an inclined manner and located in the same direction as the left end surface of the jaw 3, the two ends of the elongated pin hole 12 each are in the shape of a semicircle, and at the right end of the jaw 3 is formed a pin hole 13. The two clamp pieces 2 are provided with clamp-piece pin holes, so that the left and right ends of the jaw 3 are connected to the clamp pieces 2 by round pins 14. The round pin 14 at the right end of the jaw 3 is inserted in the elongated pin hole 12, so that the jaw 3 is rotatable, and the rotation of the jaw 3 is restricted by a relative displacement between the round pin 14 and the elongated pin hole 12, and therefore, the left end of the jaw 3 is able to rotate for an angle to clamp a relatively large workpiece. A lower edge of the jaw 3 includes, in order from a left to a right, a first arc-shaped section 4, a second arc-shaped section 5 and a horizontal section 6, so as to clamp workpieces of different shapes. The first arc-shaped section 4 forms a smooth transition with the left end surface of the jaw 3, the horizontal section 6 forms a smooth transition with the right end surface of the jaw 3, and the bottoms of the first arc-shaped section 4, the second arc-shaped section 5 and the horizontal section 6 are at the same plane, so that the clamping device will have at least four clamping points when clamping a workpiece, which allows the workpiece to be clamped more stably and easily. The arc-shaped configuration of the first and second arc-shaped sections 4 and 5 can reduce damage to the workpiece to be clamped. The first and second arcs-shaped sections 4, 5 are symmetrical to each other, between the first and second arcs-shaped sections 4, 5 is defined an angle 7, and between the second arc-shaped section 5 and the horizontal section 6 is defined a V-shaped groove 8. The first and second arc-shaped sections 4, 5 are longer than the horizontal section 6. The angle 7 and the V-shaped groove 8 are used to clamp an angular workpiece or a small sized workpiece, such as small round pipe, and small angular products. Relatively a large workpiece can be clamped between the first and second arc-shaped sections 4, 5, and small workpieces can be clamped between the second arc-shaped section 5 and the horizontal section 6. The second arc-shaped section 5 and the horizontal section 6 are provided with a toothed surface 9, which is an anti-skid design to increase friction of the jaw 3 with respect to the workpiece. At the top end surface of the jaw 3 are formed a ⅜ inch threaded hole 10 and a ¼ inch threaded hole 11, so that some other workpieces or tools can be fixed to the jaw. For example, a live concert should be shot from different angles by multiple cameras, with the threaded holes 10, 11, cameras can be directly fixed on the top end surface of the jaw 3, and then the clamping device of the present invention is fixed at a predetermined position at a desired angle. Hence, the present invention requires less installation space, and is easy to set up or take down.

The adjustment assembly includes a bolt 16, a nut 17 and a spring 18. At a lower end of the bolt 16 is provided a stop block 19 to fix the bolt 16. The bolt 16 inserts upwards through the stop block 19, the fixing rods 15 on the two clamp arms 1, and then has the top end screwed with the nut 17. The spring 18 is sleeved onto the bolt 16 and located between the fixing rods 15 on the two clamp arms 1. Rotating the nut 17 can adjust the distance between the two clamp arms 1 to clamp different sized workpieces.

While we have shown and described various embodiments in accordance with the present invention, it is clear to those skilled in the art that further embodiments may be made without departing from the scope of the present invention.

What is claimed is:

1. A clamping device, comprising a clamp assembly and an adjustment assembly, the clamp assembly comprising two symmetrical clamp arms which are oppositely hinged to each other, each of the clamp arms including two identical and parallel clamp pieces, and a jaw, the jaw being detachably connected between the two clamp pieces, the clamping device being characterized in that:

a lower edge of the jaw includes, in order from a left to a right thereof, a first arc-shaped section, a second arc-shaped section and a horizontal section, bottoms of the first arc-shaped section, the second arc-shaped section and the horizontal section are at a same plane, the first and second arc-shaped sections are symmetrical to each other, an angle is defined between the first and second arc-shaped sections, a V-shaped groove is defined between the second arc-shaped section and the horizontal section, and the first and second arc-shaped sections are each longer than the horizontal section;

an elongated pin hole which is arranged in an inclined manner is formed at a left end of the jaw, two ends of the elongated pin hole are in a shape of a semicircle, and a pin hole is formed at a right end of the jaw, the two clamp pieces are provided with clamp-piece pin holes, the left and right ends of the jaw are connected to the clamp pieces by round pins, the round pin at the right end of the jaw is inserted in the elongated pin hole, so that the jaw is rotatable, and a rotation of the jaw is restricted by a relative displacement between the round pin and the elongated pin hole.

2. The clamping device as claimed in claim 1, wherein the second arc-shaped section and the horizontal section are each provided with a toothed surface.

3. The clamping device as claimed in claim 2, wherein each of the clamp arms further includes a fixing rod fixed between the two clamp pieces, the adjustment assembly includes a bolt, a nut and a spring, the bolt inserts upwards through the fixing rods on the two clamp arms and then has a top end screwed with the nut, and the spring is sleeved onto the bolt and located between the fixing rods on the two clamp arms.

4. The clamping device as claimed in claim 3, wherein the bolt is provided with a stop block at a lower end thereof.

5. The clamping device as claimed in claim 1, wherein a threaded hole of ⅜ inch and a threaded hole of ¼ inch are formed at a top end surface of the jaw.

6. The clamping device as claimed in claim 5, wherein each of the clamp arms further includes a fixing rod fixed between the two clamp pieces, the adjustment assembly includes a bolt, a nut and a spring, the bolt inserts upwards through the fixing rods on the two clamp arms and then has a top end screwed with the nut, and the spring is sleeved onto the bolt and located between the fixing rods on the two clamp arms.

7. The clamping device as claimed in claim 6, wherein the bolt is provided with a stop block at a lower end thereof.

8. The clamping device as claimed in claim 1, wherein each of the clamp arms further includes a fixing rod fixed between the two clamp pieces, the adjustment assembly includes a bolt, a nut and a spring, the bolt inserts upwards through the fixing rods on the two clamp arms and then has a top end screwed with the nut, and the spring is sleeved onto the bolt and located between the fixing rods on the two clamp arms.

9. The clamping device as claimed in claim 8, wherein the bolt is provided with a stop block at a lower end thereof.

10. The clamping device as claimed in claim 1, wherein each of the clamp arms further includes a fixing rod fixed between the two clamp pieces, the adjustment assembly includes a bolt, a nut and a spring, the bolt inserts upwards through the fixing rods on the two clamp arms and then has a top end screwed with the nut, and the spring is sleeved onto the bolt and located between the fixing rods on the two clamp arms.

11. The clamping device as claimed in claim 10, wherein the bolt is provided with a stop block at a lower end thereof.

* * * * *